US012037881B2

(12) United States Patent
O'Malley et al.

(10) Patent No.: US 12,037,881 B2
(45) Date of Patent: Jul. 16, 2024

(54) CHEMICAL INJECTION SYSTEM FOR COMPLETED WELLBORES

(71) Applicants: Edward O'Malley, Houston, TX (US); Jason Harper, Cypress, TX (US)

(72) Inventors: Edward O'Malley, Houston, TX (US); Jason Harper, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 23 days.

(21) Appl. No.: 17/313,357

(22) Filed: May 6, 2021

(65) Prior Publication Data

US 2021/0348462 A1 Nov. 11, 2021

Related U.S. Application Data

(60) Provisional application No. 63/021,247, filed on May 7, 2020.

(51) Int. Cl.
*E21B 23/01* (2006.01)
*E21B 17/20* (2006.01)
(Continued)

(52) U.S. Cl.
CPC ..... *E21B 43/166* (2013.01); *E21B 17/20* (2013.01); *E21B 23/001* (2020.05); *E21B 23/01* (2013.01);
(Continued)

(58) Field of Classification Search
CPC ..... E21B 23/01; E21B 37/06; E21B 43/27
See application file for complete search history.

(56) References Cited

U.S. PATENT DOCUMENTS 2,942,666 A * 6/1960 Boer ..... E21B 33/127 166/123
4,637,469 A * 1/1987 Spriggs ..... E21B 23/0411 166/212
(Continued)

FOREIGN PATENT DOCUMENTS

CN 2856385 Y 1/2007
CN 203394399 U 1/2014
(Continued)

OTHER PUBLICATIONS

International Search Report and Written Opinion for International Application No. PCT/US2021/030854; International Filing Date May 5, 2021, dated Aug. 20, 2021 (pp. 1-10).
(Continued)

*Primary Examiner* — D. Andrews
*Assistant Examiner* — Ronald R Runyan
(74) *Attorney, Agent, or Firm* — CANTOR COLBURN LLP

(57) ABSTRACT

A resource exploration and recovery system including a first system, and a second system extending into a wellbore. The second system includes a completion having a casing defining a wellbore internal diameter. Chemical injection tubing extends from the first system into the completion. The chemical injection tubing includes a terminal end portion. A chemical introduction system is arranged at the first system and fluidically connected to the chemical injection tubing. The chemical introduction system is operable to deliver a chemical into the chemical injection tubing. A chemical injection assembly is mounted to the terminal end portion. The chemical injection system includes an anchor system operable to secure the chemical injection assembly to the casing.

19 Claims, 20 Drawing Sheets

(51) Int. Cl.

| | |
|---|---|
| ***E21B 23/00*** | (2006.01) |
| ***E21B 34/06*** | (2006.01) |
| ***E21B 34/14*** | (2006.01) |
| ***E21B 37/02*** | (2006.01) |
| ***E21B 37/06*** | (2006.01) |
| ***E21B 41/00*** | (2006.01) |
| ***E21B 43/10*** | (2006.01) |
| ***E21B 43/12*** | (2006.01) |
| ***E21B 43/16*** | (2006.01) |
| ***E21B 43/27*** | (2006.01) |

(52) U.S. Cl.

CPC ..... *E21B 34/063* (2013.01); *E21B 34/14* (2013.01); *E21B 37/02* (2013.01); *E21B 37/06* (2013.01); *E21B 41/0078* (2013.01); *E21B 43/106* (2013.01); *E21B 43/124* (2013.01); *E21B 43/27* (2020.05); *E21B 2200/02* (2020.05)

(56) References Cited

U.S. PATENT DOCUMENTS

| | | | | |
|---|---|---|---|---|
| 4,971,146 | A * | 11/1990 | Terrell | E21B 29/02 166/212 |
| 5,158,140 | A | 10/1992 | Ferry | |
| 5,168,933 | A * | 12/1992 | Pritchard, Jr. | E21B 33/043 166/212 |
| 5,236,036 | A | 8/1993 | Ungemach | |
| 5,505,262 | A | 4/1996 | Cobb | |
| 5,638,904 | A | 6/1997 | Misselbrook et al. | |
| 5,794,703 | A | 8/1998 | Newman et al. | |
| 6,029,746 | A | 2/2000 | Dodd | |
| 6,047,773 | A | 4/2000 | Zeltmann et al. | |
| 6,273,189 | B1 | 8/2001 | Gissler et al. | |
| 6,547,011 | B2 | 4/2003 | Kilgore | |
| 7,451,827 | B2 * | 11/2008 | Carro | E21B 21/10 166/212 |
| 8,066,072 | B2 | 11/2011 | Lumbye | |
| 8,186,459 | B1 | 5/2012 | Mazorow et al. | |
| 8,196,663 | B2 | 6/2012 | Bolding | |
| 9,322,239 | B2 | 4/2016 | Angeles Boza et al. | |
| 10,024,141 | B2 | 7/2018 | Swinford | |
| 10,094,201 | B2 * | 10/2018 | Barry | E21B 37/06 |
| 2003/0056954 | A1 | 3/2003 | Headworth | |
| 2003/0221830 | A1 * | 12/2003 | Leising | E21B 43/04 166/278 |
| 2004/0138068 | A1 * | 7/2004 | Rimmer | E21B 37/06 507/100 |
| 2005/0217861 | A1 | 10/2005 | Misselbrook | |
| 2008/0169106 | A1 * | 7/2008 | Hill | E21B 43/25 166/73 |
| 2009/0114385 | A1 | 5/2009 | Lumbye | |
| 2009/0242208 | A1 | 10/2009 | Bolding | |
| 2011/0079382 | A1 * | 4/2011 | Patel | E21B 37/06 166/90.1 |
| 2011/0162839 | A1 | 7/2011 | Hansen | |
| 2014/0116724 | A1 | 5/2014 | McDougall et al. | |
| 2017/0159384 | A1 | 6/2017 | Romer et al. | |
| 2019/0120035 | A1 | 4/2019 | Livescu et al. | |
| 2019/0153841 | A1 | 5/2019 | Randall et al. | |

FOREIGN PATENT DOCUMENTS

| | | | | |
|---|---|---|---|---|
| CN | 106894787 | A | 6/2017 | |
| CN | 208816084 | U | 5/2019 | |
| WO | WO-2006069247 | A2 * | 6/2006 | E21B 34/106 |

OTHER PUBLICATIONS

International Search Report and Written Opinion for International Application No. PCT/US2021/030857; International Filing Date May 5, 2021, dated Aug. 17, 2021 (pp. 1-18).

International Search Report and Written Opinion for International Application No. PCT/US2021/030859; International Filing Date May 5, 2021, dated Aug. 20, 2021 (pp. 1-11).

Chinese Application No. 202180030478.7 filed May 5, 2021; Chinese Office Action with English Translation dated Jun. 5, 2023; 13 pages.

* cited by examiner

CHEMICAL INJECTION SYSTEM FOR COMPLETED WELLBORES

CROSS-REFERENCE TO RELATED APPLICATIONS

This application claims priority to U.S. Patent Application No. 63/021,247, filed May 7, 2020, the contents of which are incorporated by reference herein in their entirety.

BACKGROUND

In the resource exploration and recovery industry, boreholes are formed in a formation for the purpose of evaluating formation properties and to extract formation fluids. Prior to extracting formation fluids, a completion is formed in the borehole. The completion may separate the borehole into various production zones through the use of packers. The completion may also include various screen assemblies and valve assemblies that are selectively utilized to direct fluids from the formation, into a tubular, and toward the surface.

In some cases, the completion is provided with a chemical injection system that may introduce various chemicals into the borehole to treat the formation fluids flowing toward the surface. The fluid treatment may reduce any formation of, for example, scale formation on downhole components. Injected chemicals might also inhibit corrosion of completion components, prevent formation of oil/water emulsions, scavenge undesirable materials out of the flow stream, etc.

In other cases, the completion is not installed with a chemical injection system. In the latter case, a variety of well issues could arise such as, an accumulation of scale on downhole components. The scale may slow or plug production. In completions without chemical injection systems, when scale begins to impact production, a scale treatment must be performed. In many cases, coiled tubing has to be run down into the completion to open clogged flow paths. The need to perform scale treatment imparts production delays and increases production costs. Therefore, the industry would welcome a post completion chemical injection system.

SUMMARY

Disclosed is a resource exploration and recovery system including a first system and a second system extending into a wellbore. The second system includes a completion having a casing defining a wellbore internal diameter. A chemical injection tubing extends from the first system into the completion. The chemical injection tubing includes a terminal end portion. A chemical introduction system is arranged at the first system and is fluidically connected to the chemical injection tubing. The chemical introduction system is operable to deliver a chemical into the chemical injection tubing. A chemical injector assembly is mounted to the terminal end portion. The chemical injection system includes an anchor and a chemical injector valve.

Also disclosed is a method of treating a completed wellbore including introducing chemical injection tubing having a terminal end portion into a completion and injecting a treatment fluid through an injector assembly mounted at the terminal end portion.

BRIEF DESCRIPTION OF THE DRAWINGS

The following descriptions should not be considered limiting in any way. With reference to the accompanying drawings, like elements are numbered alike:

FIG. 10 depicts a cross-sectional side view of a chemical injector assembly including an anchor portion and a chemical injection valve, in accordance with an aspect of an exemplary embodiment;

DETAILED DESCRIPTION

A detailed description of one or more embodiments of the disclosed apparatus and method are presented herein by way of exemplification and not limitation with reference to the Figures.

Figure 1:
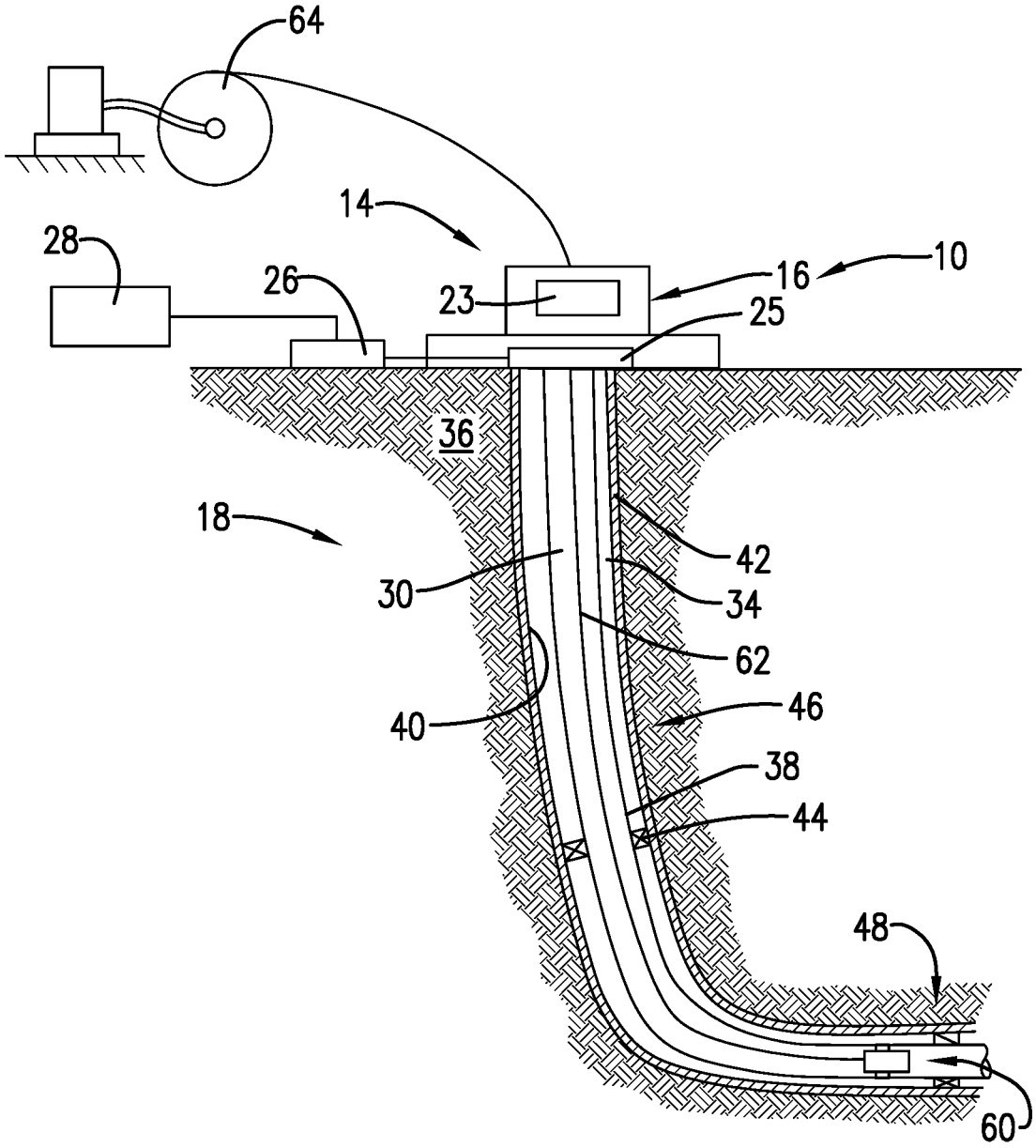
FIG. 1 depicts a resource exploration and recovery system including a completion and a chemical injection system, in accordance with an exemplary embodiment.
Figure 2:
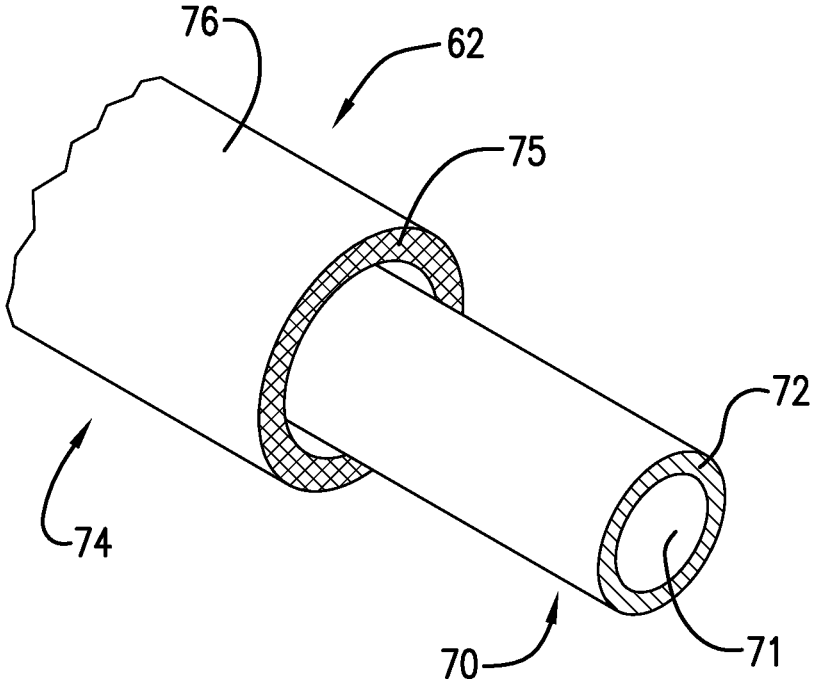
FIG. 2 depicts a cross-sectional view of chemical injection tubing of the chemical injection system if FIG. 1, in accordance with an aspect of an exemplary embodiment.

A resource exploration and recovery system, in accordance with an exemplary embodiment, is indicated generally at 10, in FIGS. 1 and 2. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 also includes a chemical introduction system 25 that is connected to a chemical pump 26. Chemical pump 26 may deliver a chemical from a chemical reservoir 28 into chemical introduction system 25 as will be detailed herein. Surface system 16 may include additional systems such as pumps, fluid storage systems, cranes and the like (not shown). Second system 18 may include a tubular string 30 that extends into a wellbore 34 formed in a formation 36.

Tubular string 30 may take the form of a completion 38 and could be formed from a plurality of interconnected tubulars. Wellbore 34 includes an annular wall 40 which, in the embodiment shown, is defined by a casing tubular 42. Completion 38 supports a number of packers or expandable annular seals, one of which is indicted at 44 that extend between tubular string 30 and annular wall 40. Packers 44 separate wellbore 34 into a number of production zones (not separately labeled). In the exemplary embodiment shown, wellbore 34 includes a generally vertical portion 46 and an angled portion 48 that may extend generally horizontally relative to vertical portion 46.

In an embodiment, a chemical injector assembly 60 is run into tubular string 30. Chemical injector assembly 60 is coupled to a control line, a hydraulic line, a capillary string, chemical injection tubing or the like. In the embodiment shown, chemical injector assembly 60 is provided on chemical injection tubing 62. Chemical injection tubing 62 may be run into wellbore 34 from a reel 64 at surface system 16. Once installed, chemical injection tubing 62 may be connected to chemical reservoir 28 through chemical pump 26 as will be detailed herein.

In accordance with an exemplary aspect depicted in FIG. 2, chemical injection tubing 62 may include an inner tubular 70 defining a chemical resistant inner surface 71. It should be understood that inner tubular 70 may not be provided. Inner tubular 70, if provided, may be formed from stainless steel 72. Alternatively, inner tubular 70 may be formed from carbon steel and/or thermoplastic. An outer tubular 74 may be disposed about inner tubular 70. Outer tubular 74 may be formed from a non-electrically conducting material such as carbon fiber 75 that forms an outer protective surface 76. Alternatively, outer tubular 74 may be formed from Polyetheretherketone (PEEK), and/or polytetrafluoroethylene (PTFE). Outer protective surface 76 may provide mechanical protection, chemical protection, act as a stiffening element to provide a selected stiffness, and/or act as a glide surface having a selected friction coefficient that aids in installation to wellbore 34.

Figure 3:
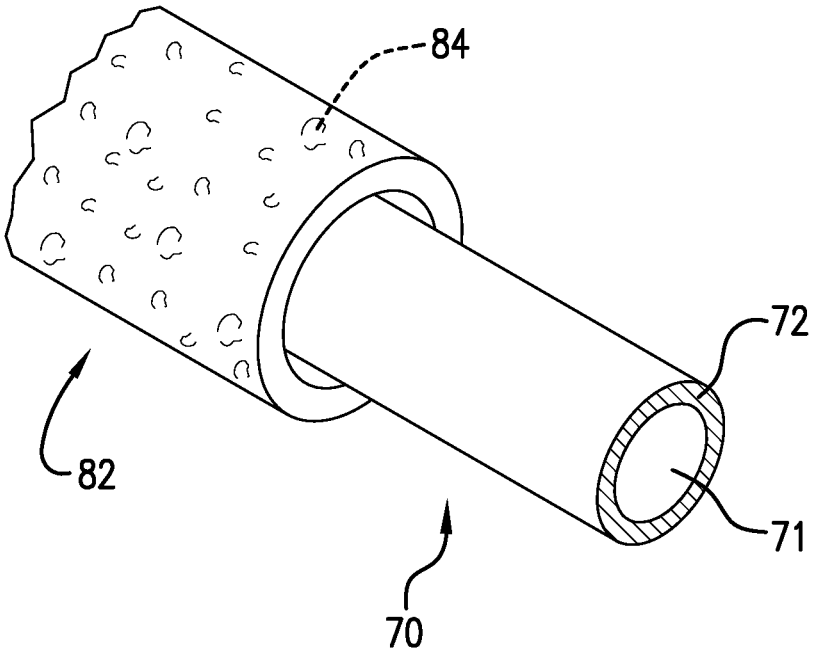
FIG. 3 depicts a cross-sectional view of chemical injection tubing of the chemical injection system if FIG. 1, in accordance with another aspect of an exemplary embodiment

In accordance with another exemplary aspect, chemical injection tubing 62 may be configured to be buoyant in a fluid introduced into wellbore 34. That is, outer tubular 74 may be formed from a material that is buoyant in a selected fluid that is introduced into wellbore 34 from surface system 16. In accordance with an exemplary aspect, chemical injection tubing 62 may be neutrally buoyant in downhole fluids injected into an annulus of wellbore 34 and/or tubular string 30. In accordance with another exemplary aspect, chemical injection tubing 62 may include an outer tubular 82 such as shown in FIG. 3 that includes a buoyant material 84 such as trapped air bubbles, trapped chemical bubbles, or other trapped fluid/gas that promotes a desired buoyancy. By forming chemical injection tubing 62 to be neutrally buoyant, friction that may occur during installation may be reduced such that chemical injection may take place at or near a toe (not shown) of wellbore 34.

Figure 4:
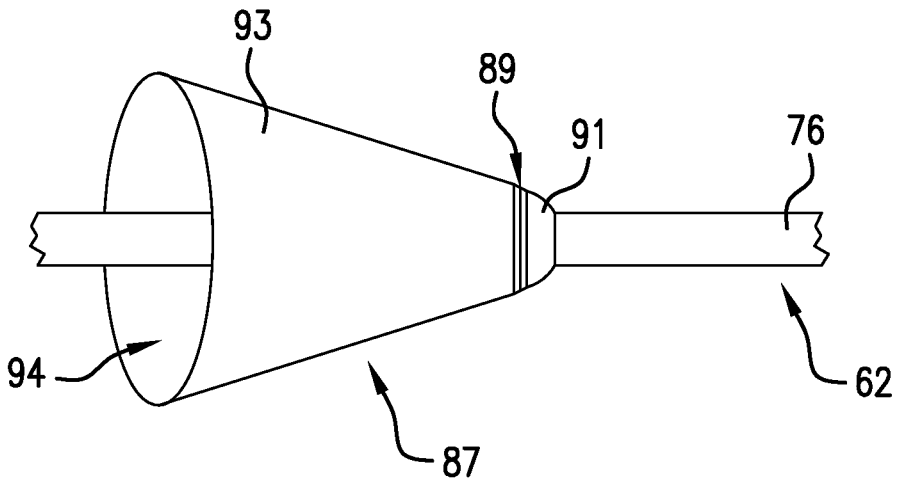
FIG. 4 depicts a side view of a wiper mounted to the chemical injection tubing of the chemical injection system, in accordance with an aspect of an exemplary embodiment.
Figure 5:
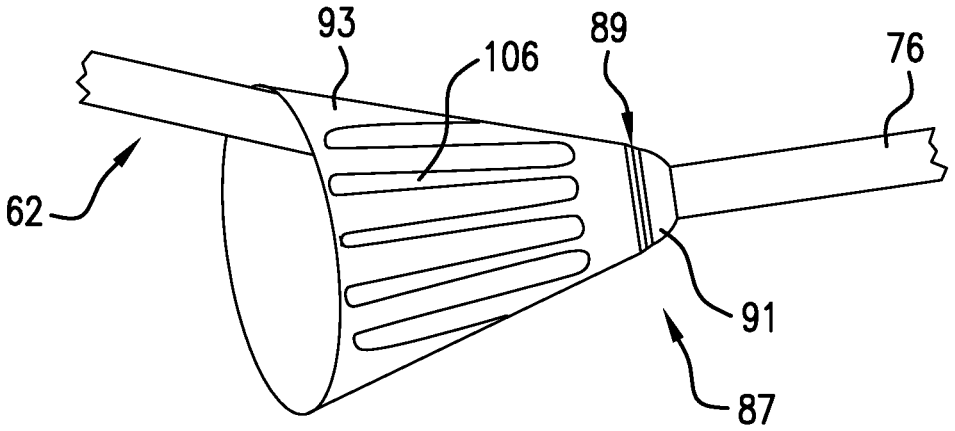
FIG. 5 depicts a side view of a wiper mounted to the chemical injection tubing of the chemical injection system, in accordance with an aspect of an exemplary embodiment.

In accordance with another exemplary aspect, chemical injection tubing 62 may be fitted with one or more wipers, such as shown at 87 in FIG. 4, that allows chemical injector assembly 60 to be pumped into wellbore 34 to a selected location. For example, chemical injector assembly 60 may be pumped down to a first perforation (not separately labeled) that is taking on fluid. Wiper 87 includes a central portion 89 that may be fitted with a clamp 91 for attachment to chemical injection tubing 62 and a fin 93 that forms a fluid receiving zone 94. In this manner, fluid may be introduced into wellbore 34 to act upon each wiper 87 to move chemical injector assembly 60 along angled portion 48. Fin 93 may include an outer diameter that is equal to or larger than an inner surface (not separately labeled) of tubular string 30 so as to trap as much fluid as possible, or one that may be smaller so as to allow a bypass. Fin 93 may be offset relative to chemical injection tubing 62 such as shown in FIG. 5.

Figure 6:
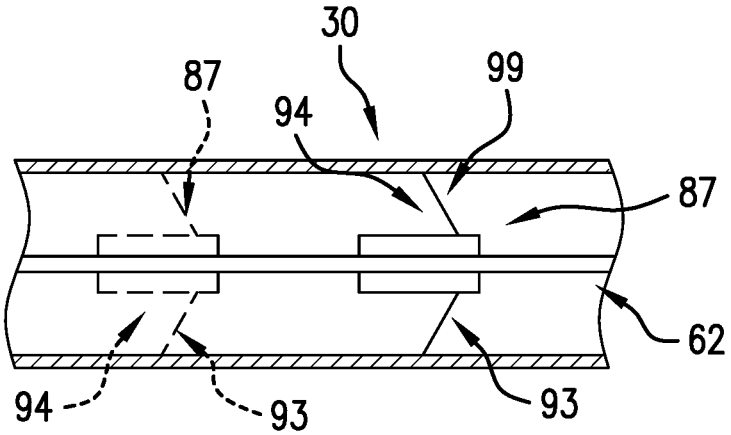
FIG. 6 depicts a side view of a wiper mounted to a chemical injection tubing beginning to degrade, in accordance with an aspect of an exemplary embodiment.
Figure 7:
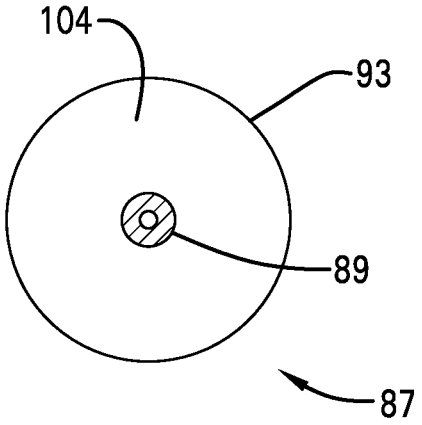
FIG. 7 depicts an axial end view of a wiper mounted to the chemical injection tubing, in accordance with an aspect of an exemplary embodiment.
Figure 8:
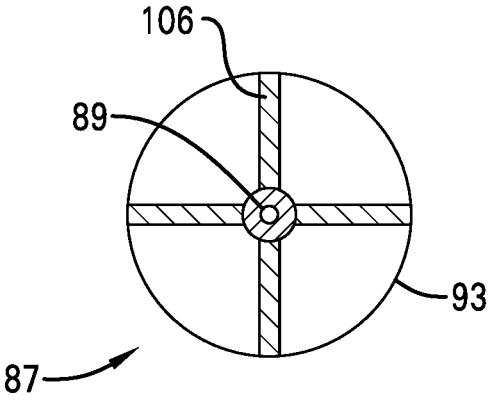
FIG. 8 depicts an axial end view of a wiper mounted to the chemical injection tubing, in accordance with another aspect of an exemplary embodiment.
Figure 9:
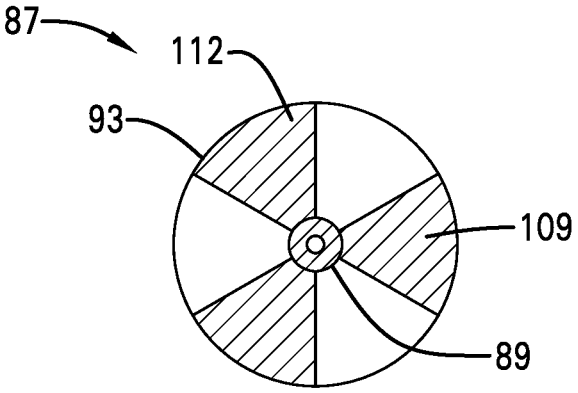
FIG. 9 depicts an axial end view of a wiper mounted to the chemical injection tubing, in accordance with yet another aspect of an exemplary embodiment.
Figure 1O:
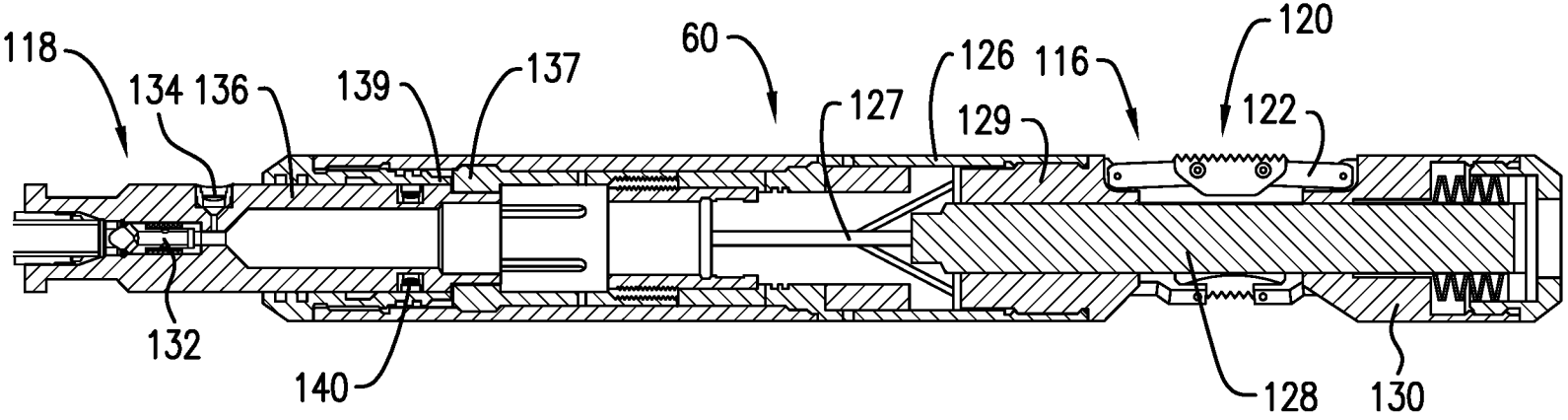

In accordance with another exemplary aspect, wiper 87 may include a degradable portion 99. That is, each fin 93 may be formed all, or in part, from a degradable material such as shown in FIG. 6. In this manner, wiper 87 may be used to motivate chemical injector assembly 60 along well bore 34 and later be removed to avoid interference with production fluid flow. As also shown in FIG. 6, multiple wipers 87 may be employed to motivate chemical injection tubing 62 downhole. In an exemplary aspect shown in FIG. 7, fin 93 may include a continuous outer surface 104. In another exemplary aspect, fin 93 may include centralizing ribs 106 such as shown in FIG. 5 and FIG. 8. that promote a centering of wiper 87 in tubular string 30. Centralizing ribs 106 may remain after other portions of fin 93 degrade. In FIG. 9, wiper 87 is shown to include fixed portions 109 and folding portions 112. Folding portions 112 remain radially outwardly deployed during run-in and then may fold radially inwardly when exposed to production flows.

Once in position, chemical injection tubing 62 may be connected to chemical introduction system 25. A chemical is passed into chemical injection tubing 62 to chemical injector assembly 60 to initiate a fluid treatment process. The introduction of the chemical may reduce any formation of, for example, scale on downhole components. Injected chemicals might also inhibit corrosion of completion components, prevent formation of oil/water emulsions, scavenge undesirable materials out of the flow stream, enhance production and the like. After the fluid treatment process is complete, chemical injection tubing 62 may be shifted to another region of wellbore 34 to initiate another fluid treatment operation or, if fluid treatment and/or production of formation fluids is complete, chemical injection tubing 62 may be withdrawn from wellbore 34 following treatment.

Figure 11:
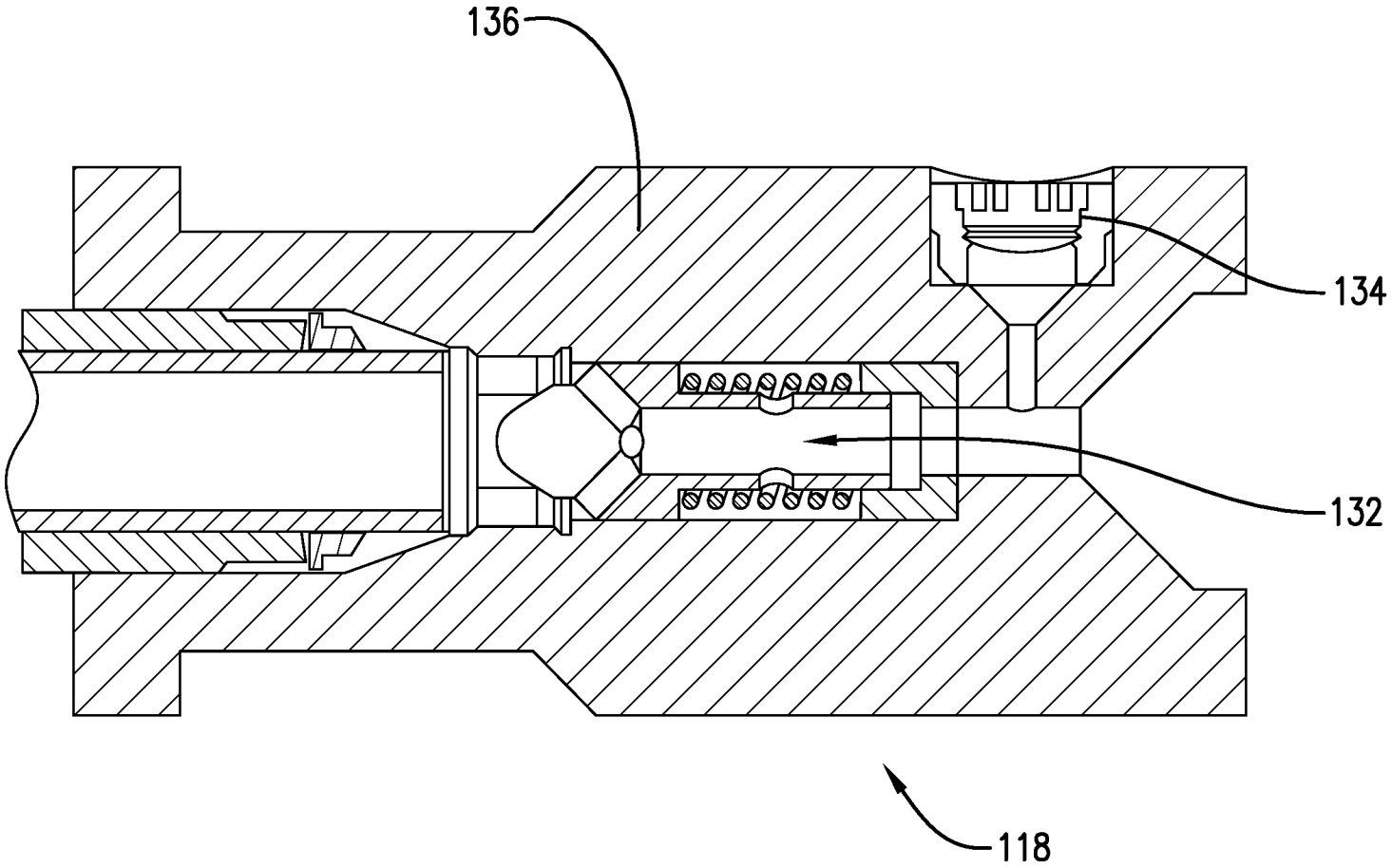
FIG. 11 is a cross-sectional side view of the chemical injection valve of the chemical injector assembly of FIG. 10, in accordance with an aspect of an exemplary embodiment.

Reference will now follow to FIGS. 10-15 in describing chemical injector assembly 60 in accordance with an exemplary embodiment. Chemical injector assembly 60 includes an anchor portion 116 and an injector portion 118. Anchor portion 116 includes a plurality of slips 120 that are radially shiftable (inwardly and outwardly) through operation of a linkage 122. Chemical injector assembly 60 includes an actuator housing 126 that surrounds a fluid delivery member/piston 127 that is coupled to an actuator rod 128. Actuator rod 128 spans between a first rod support 129 and a second rod support 130. Actuator rod 128 may be fixedly connected to second rod support 130. First rod support 129 may shift over actuator rod 128 when acted upon by fluid delivery member/piston 127. As shown in FIG. 11 and with continued reference to FIG. 10, injector portion 118 includes an injector valve 132 and a burst disc 134 that selectively covers an outlet (not separately labeled).

Figure 12:
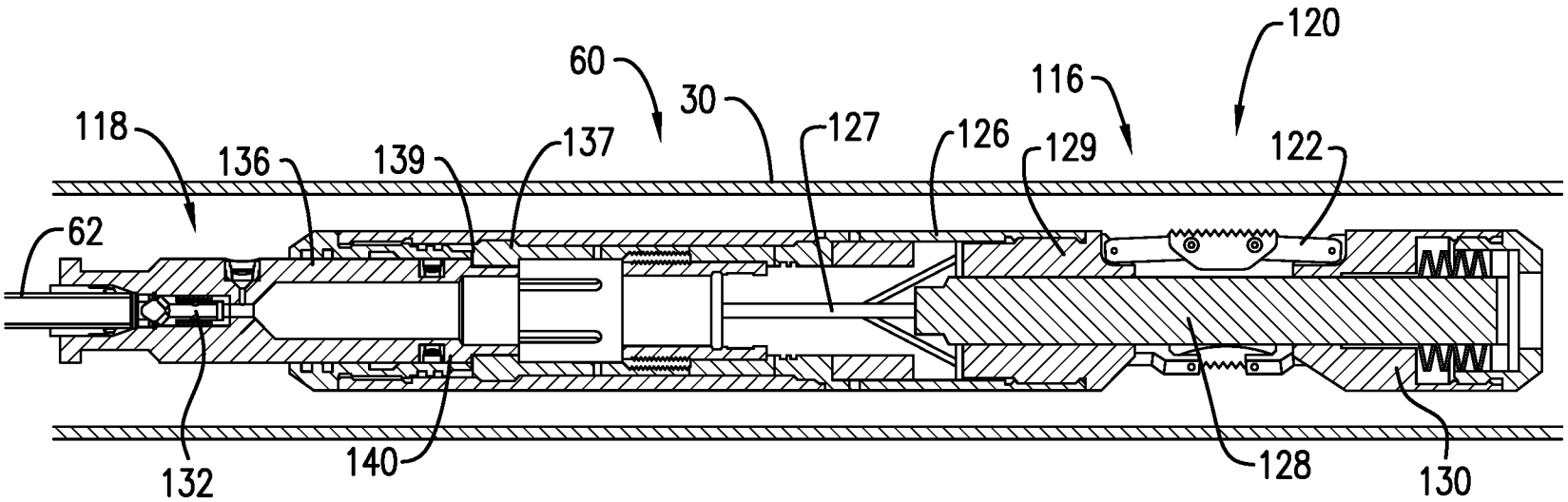
FIG. 12 depicts a cross-sectional side view of the chemical injector assembly of FIG. 10 in a run-in-hole (RIH) configuration, in accordance with an exemplary aspect.
Figure 13:
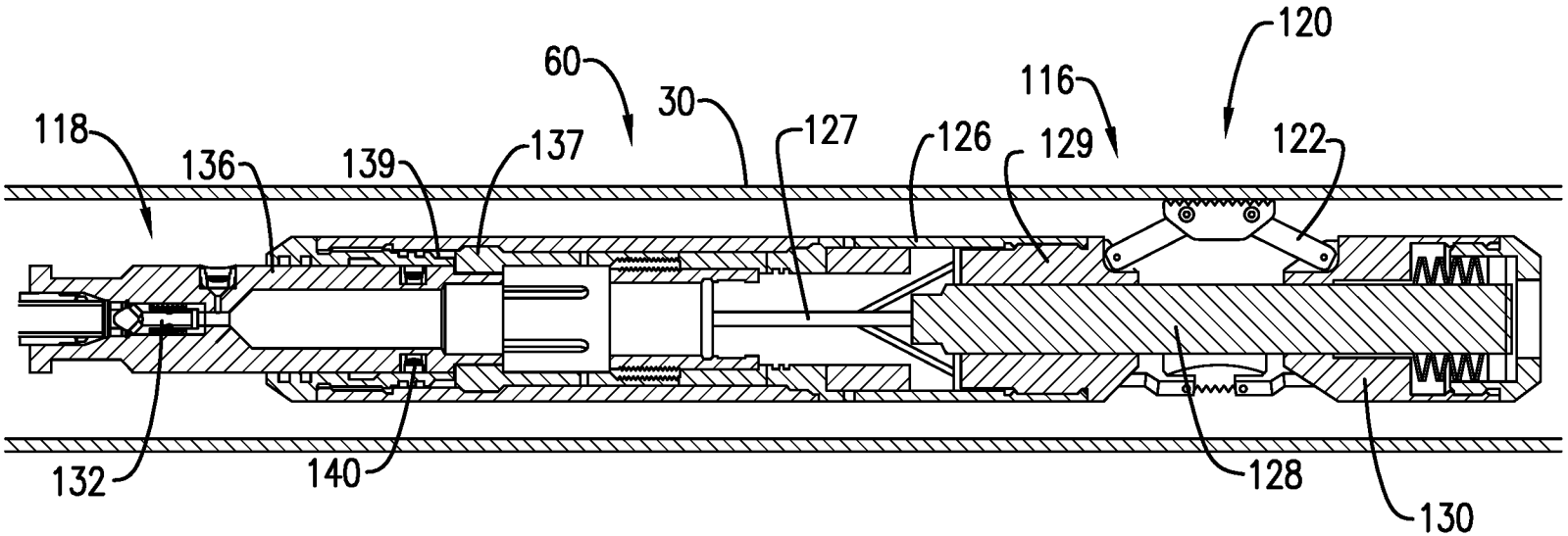
FIG. 13 depicts a cross-sectional side view of the chemical injector assembly of FIG. 12 in a pressure up configuration, in accordance with an exemplary aspect.

In an embodiment, chemical injector assembly 60 may be run-in to tubular string 30 to a selected depth as shown in FIG. 12. At this point, pressurized fluid may pass through chemical injection tubing 62 and injector portion 118. The pressurized fluid may act upon first rod support 129 causing fluid delivery member/piston 127 to move as shown in FIG. 13 causing slips 120 to radially outwardly expand and lock chemical injector assembly 60 to tubular string 30 at the selected depth.

Figure 14:
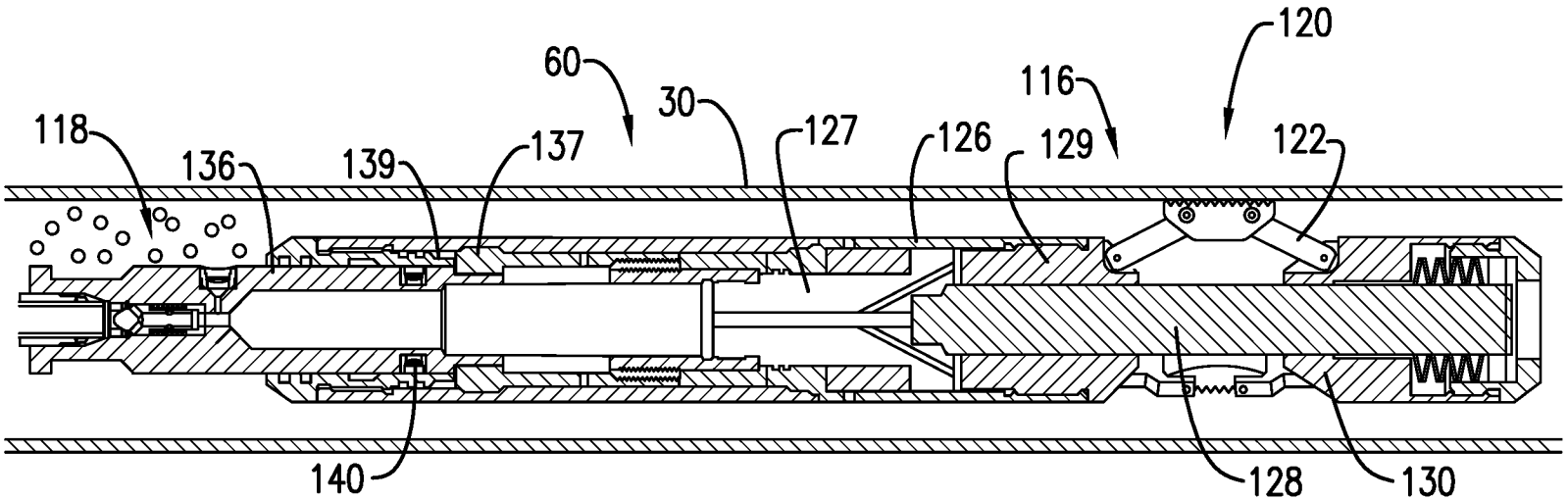
FIG. 14 depicts a cross-sectional side view of the chemical injector assembly of FIG. 13 in chemical injection configuration, in accordance with an exemplary aspect.
Figure 15:
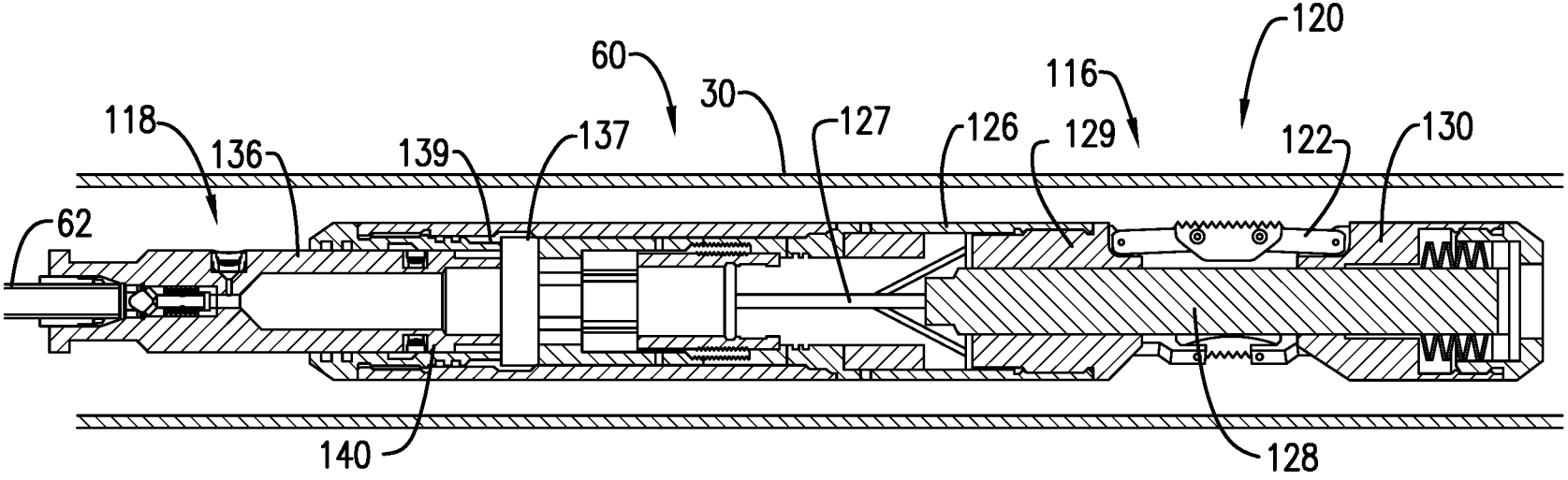
FIG. 15 depicts a cross-sectional side view of the chemical injector assembly of FIG. 14 in a retrieval configuration, in accordance with an exemplary aspect.

Once slips 120 are deployed, additional fluid pressure may be introduced into chemical injection tubing 62. The additional fluid pressure caused burst disc 134 to fail allowing the fluid to pass through injector valve 132 into tubular string 30 as shown in FIG. 14. When it is desired to withdraw the chemical injector assembly 60, an uphole force may be applied to chemical injection tubing 62 such as shown in FIG. 15. The uphole force acts on, and shifts upwardly, a retrieval member 136 breaking a shear pin 139 and engaging dogs 140. At this point, a force directed in a downhole direction is introduced through chemical injection tubing 62. The downhole force shifts and allows collet fingers 137 to deflect radially inwardly causing rod 128 to shift and release slips 120. Chemical injector assembly 60 may then be withdrawn from tubular string 30.

Figure 16:
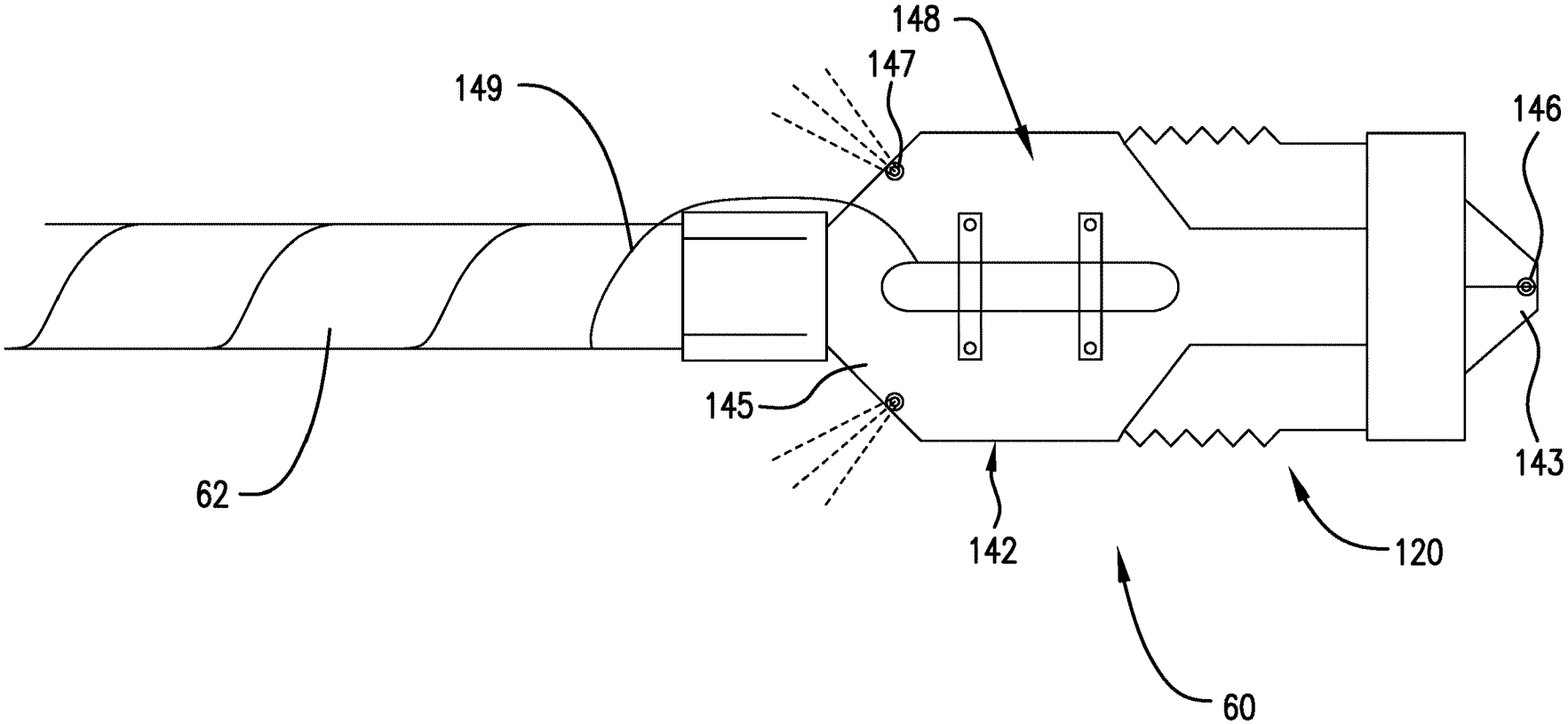
FIG. 16 depicts a chemical injector assembly including a propulsion nozzle, in accordance with an aspect of an exemplary embodiment.
Figure 17:
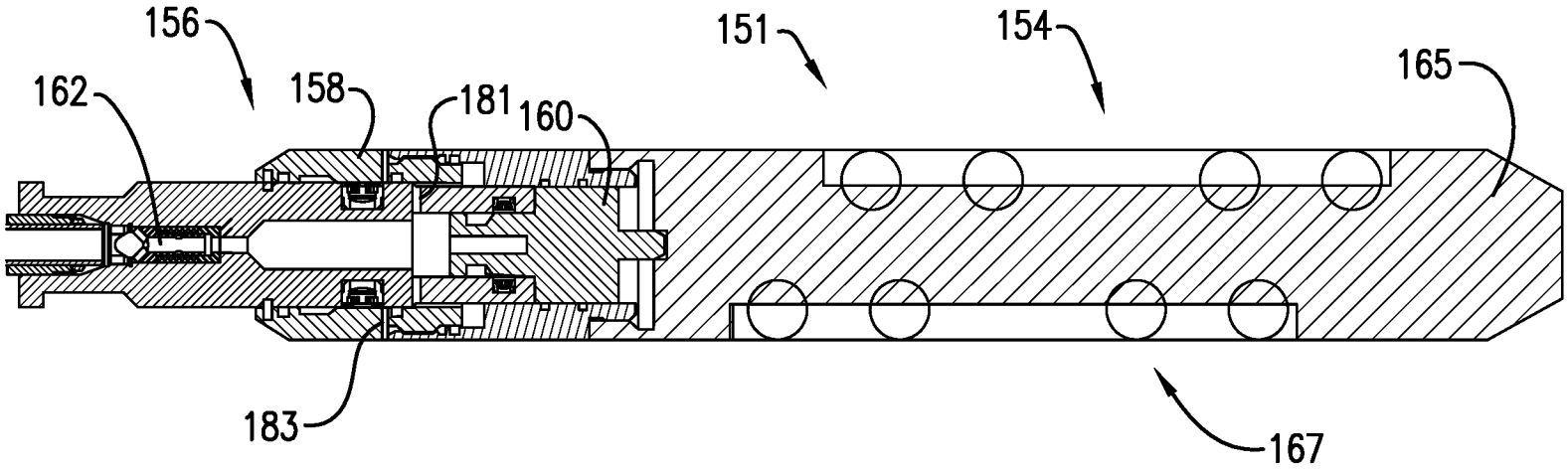
FIG. 17 depicts a chemical injector assembly including a tractor portion and a chemical injector valve, in accordance with an aspect of an exemplary embodiment.

In FIG. 16, chemical injector assembly 60 is shown to include a body 142 having a first or forward portion 143 and a second or rear portion 144. Forward portion 143 includes a chemical outlet 145 and rear portion 144 includes a propulsion system 146 in the form nozzles that may direct fluid in an uphole direction. Body 142 also supports one or more gauges 148 that may be coupled to surface system 16 through chemical injection tubing 62. Gauges 148 may provide data through conductor 149 to operators and/or control system 23 regarding parameters in wellbore 34 associated with injection. For example, gauges may provide feedback regarding temperature, depth, injection volume, application force (uphole and/or downhole direction) and the like. In the embodiment shown, propulsion nozzles 147 may provide a motive force that aids in directing chemical injection tubing 62 into wellbore 34.

Figure 18:
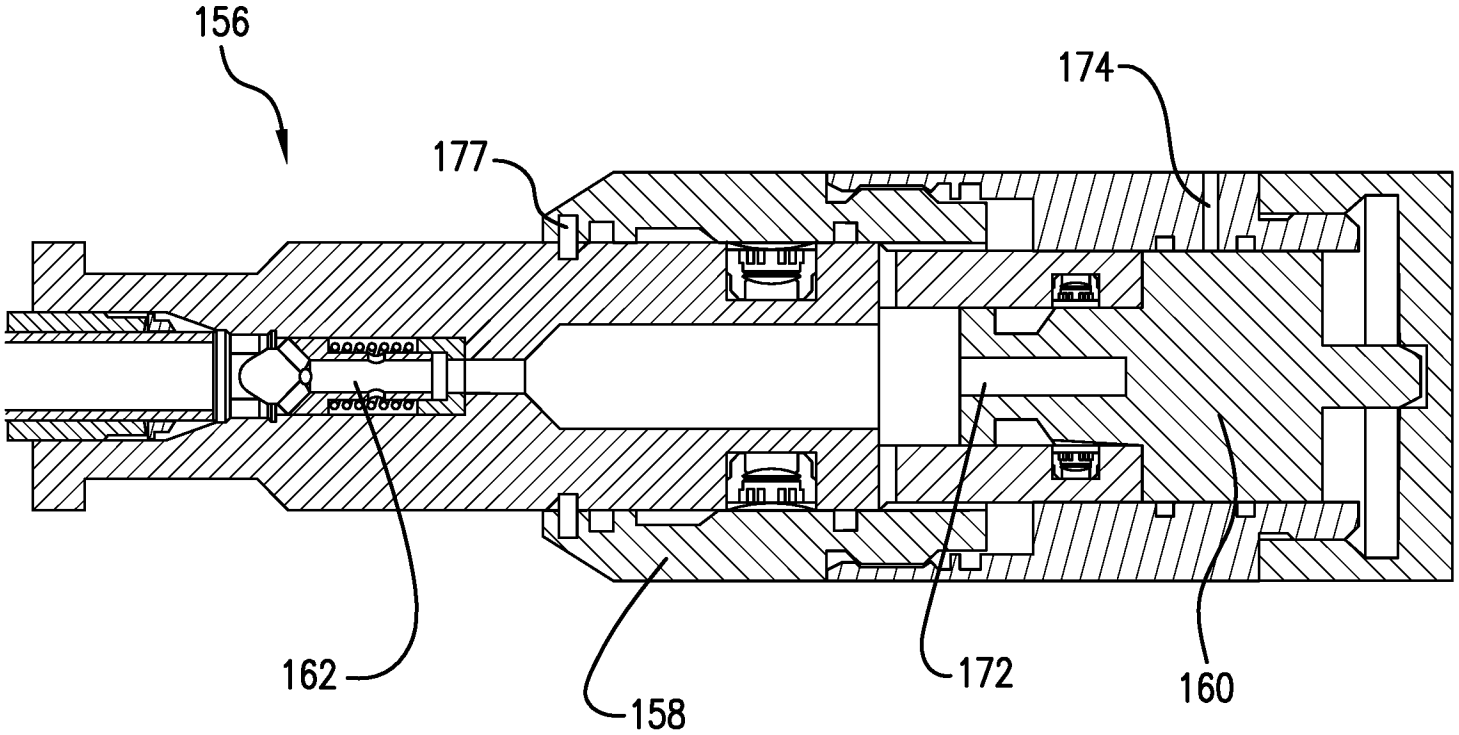
FIG. 18 depicts the chemical injector valve of the chemical injector assembly of FIG. 17, in accordance with an aspect of an exemplary embodiment.

Reference will now follow to FIGS. 17-25 in describing a chemical injector assembly 151 in accordance with another aspect of an exemplary embodiment. Chemical injector assembly 151 includes a tractor portion 154 and an injector portion 156. As shown in FIG. 18, injector portion 156 includes a housing 158 that supports a motor 160 and an injector valve 162. Motor 160 is selectively connected to, and drives tractor portion 154. Tractor portion 154 includes a tractor body 165 supporting a plurality of selectively deployable wheels 167.

Figure 19:
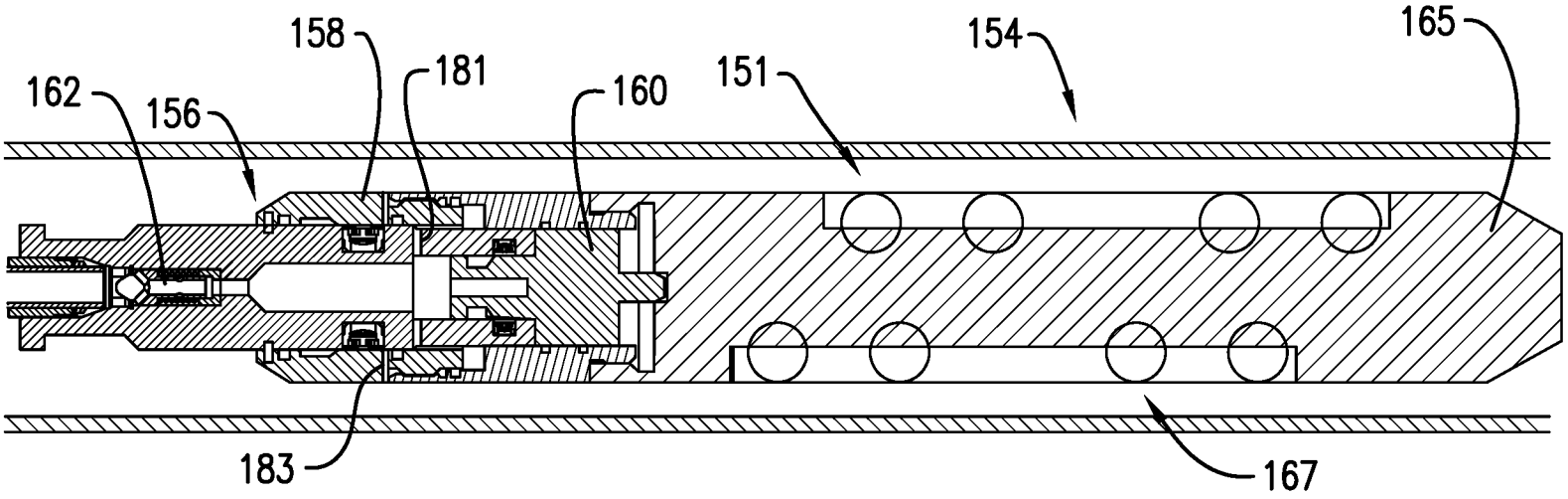
FIG. 19 depicts a cross-sectional side view of the chemical injector assembly of FIG. 17 in a run-in-hole (RIH) configuration, in accordance with an exemplary aspect.
Figure 20:
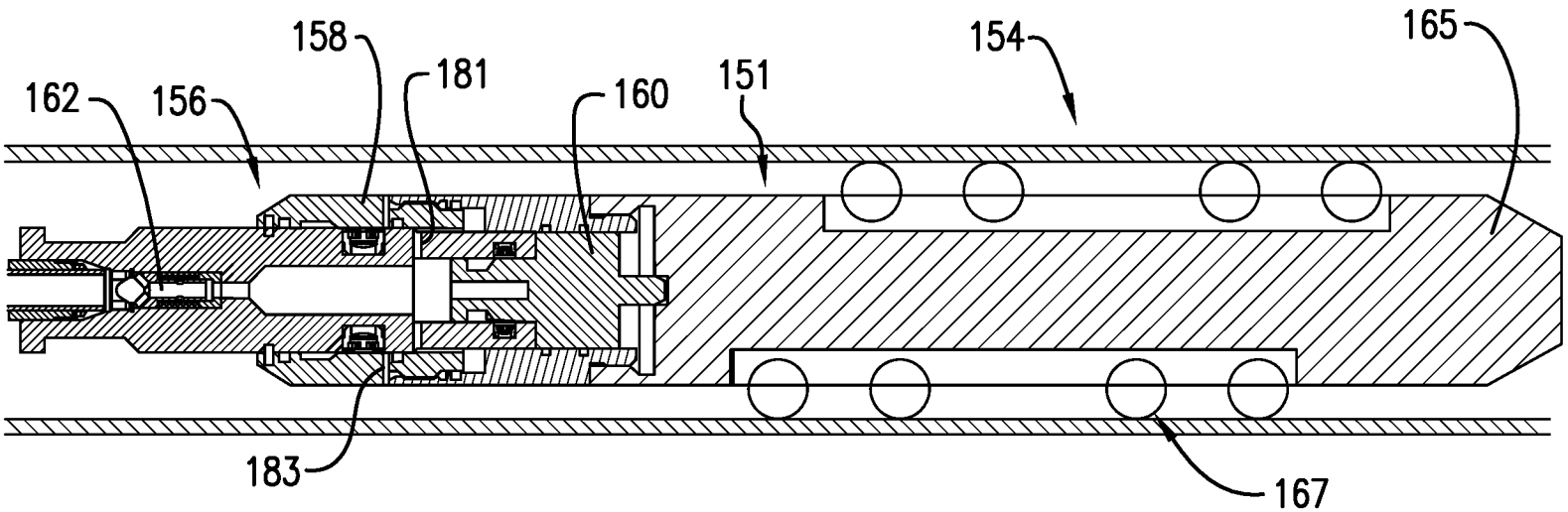
FIG. 20 depicts a cross-sectional side view of the chemical injector assembly of FIG. 17 in a propulsion configuration, in accordance with an exemplary aspect.
Figure 21:
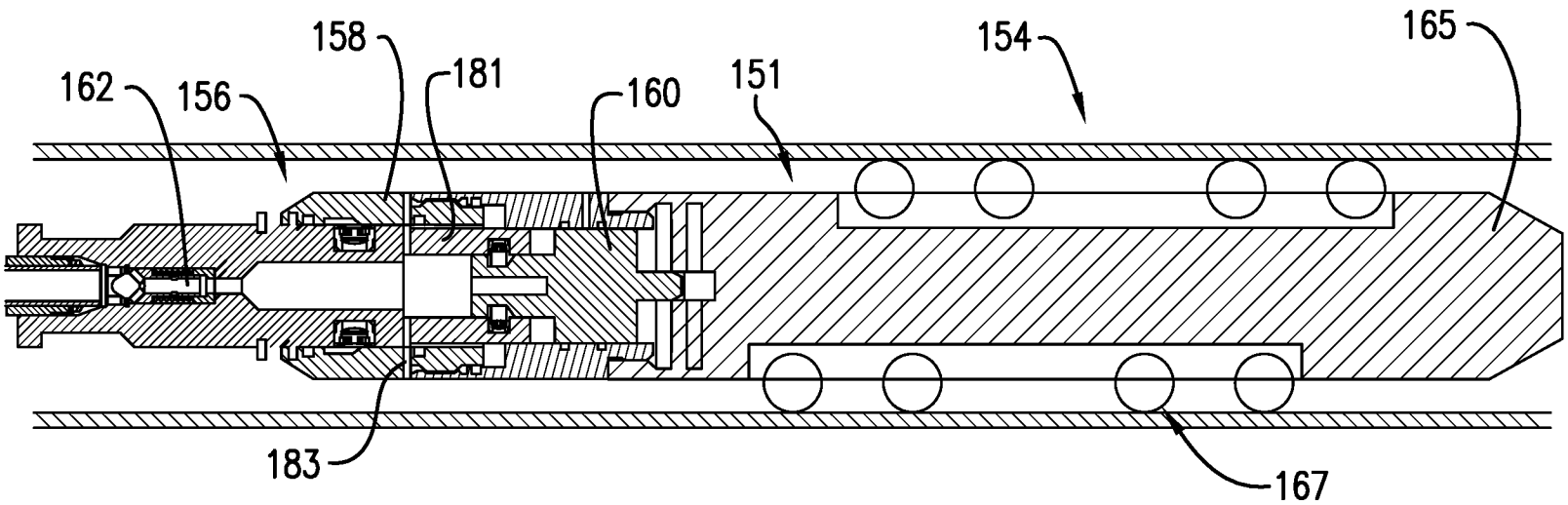
FIG. 21 depicts a cross-sectional side view of the chemical injector assembly of FIG. 17 preparing for chemical injection, in accordance with an exemplary aspect.

In an embodiment, motor 160 is operatively connected to the plurality of selectively deployable wheels 167. Motor 160 includes a motor inlet 172 and a motor outlet 174. A flow of fluid from motor inlet 172 to motor outlet 174 develops a rotary force that drives selectively deployable wheels 167. That is, chemical injector assembly 151 is run-in to tubular string 30 as shown in FIG. 19 and lowered, toward angled portion 48. Once at angled portion 48, fluid flow is introduced into chemical injection tubing 62 as shown in FIG. 20. The flow of fluid acts upon motor 160 causing plurality of selectively deployable wheels 167 to deploy and begin to rotate. Selectively deployable wheels 167 motivate chemical injector assembly 151 to a selected location along wellbore 34.

Figure 22:
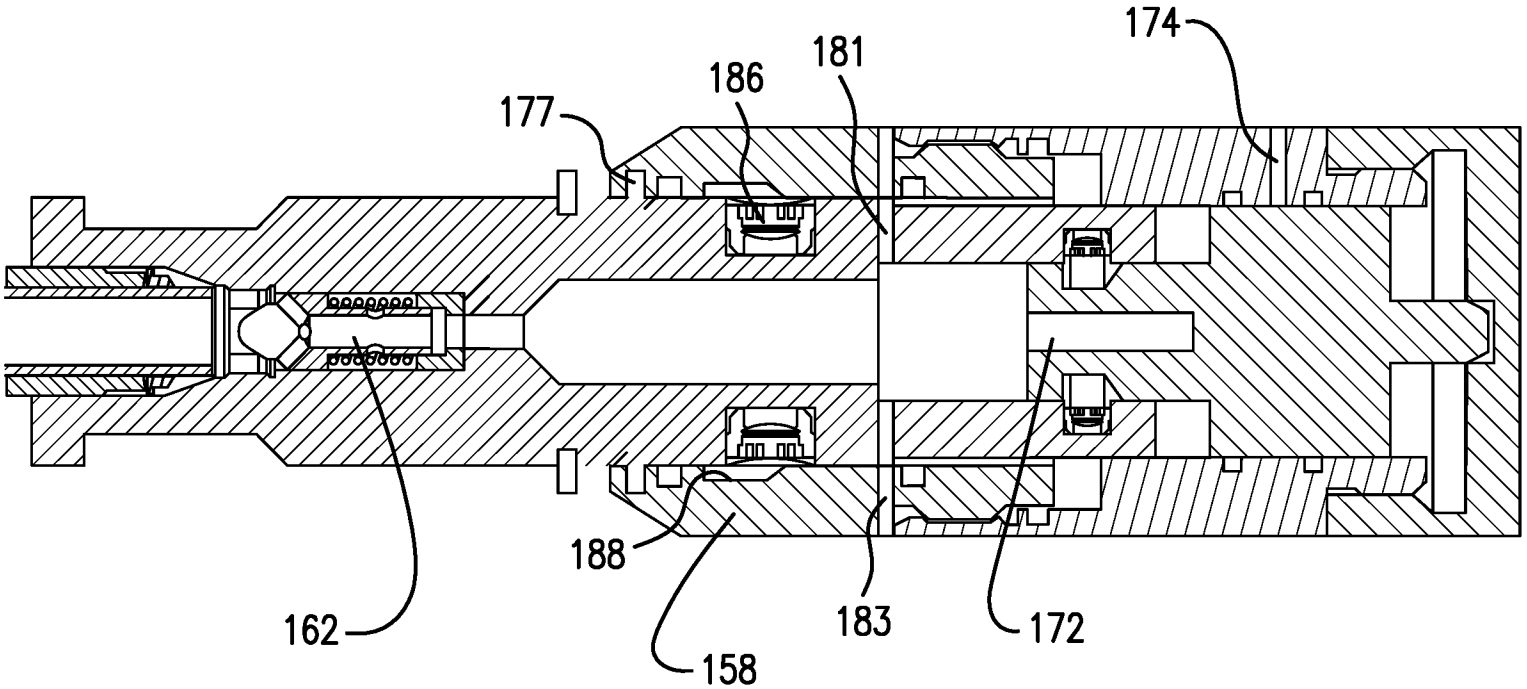
FIG. 22 depicts a cross-sectional side view of the chemical injector valve of FIG. 21, in accordance with an exemplary aspect.
Figure 23:
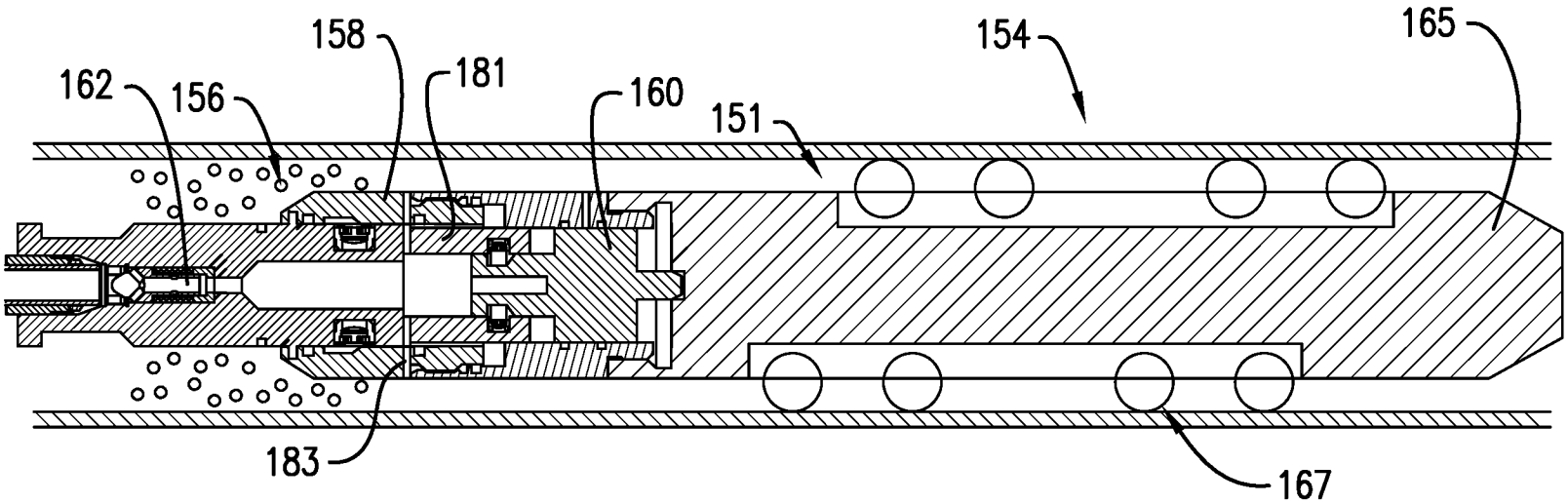
FIG. 23 depicts a cross-sectional side view of the chemical injector assembly of FIG. 17 in a chemical injection configuration, in accordance with an exemplary aspect.
Figure 24:
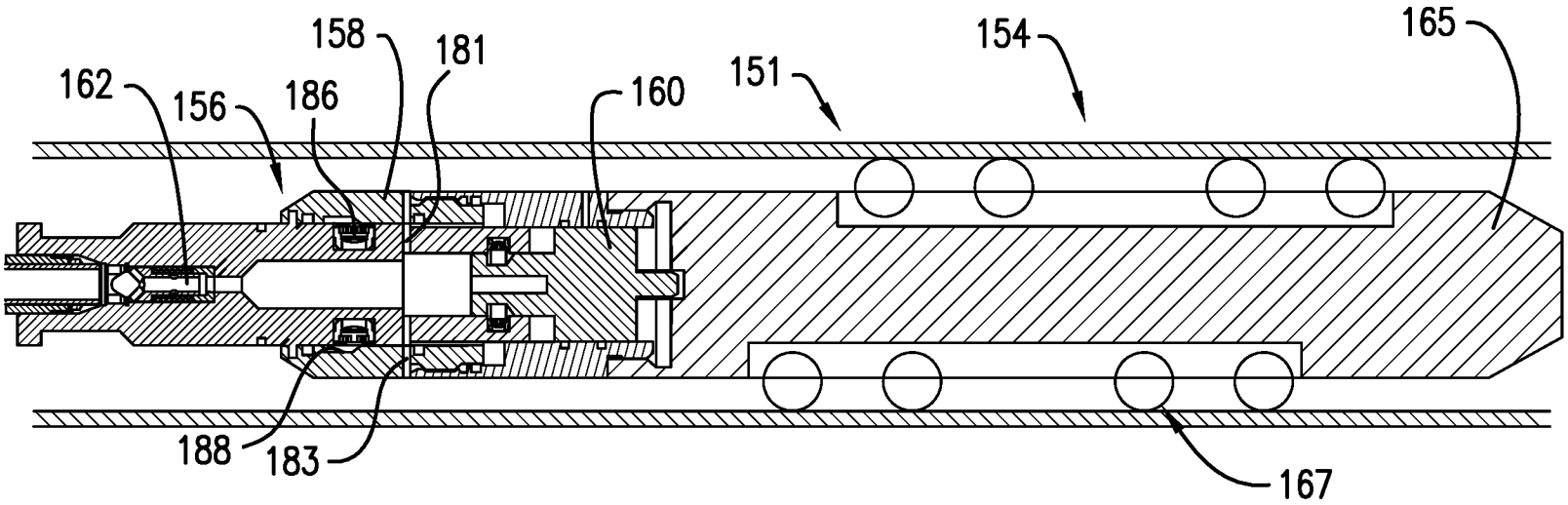
FIG. 24 depicts a cross-sectional side view of the chemical injector assembly of FIG. 17 disengaging a motor drive configuration, in accordance with an exemplary aspect.
Figure 25:
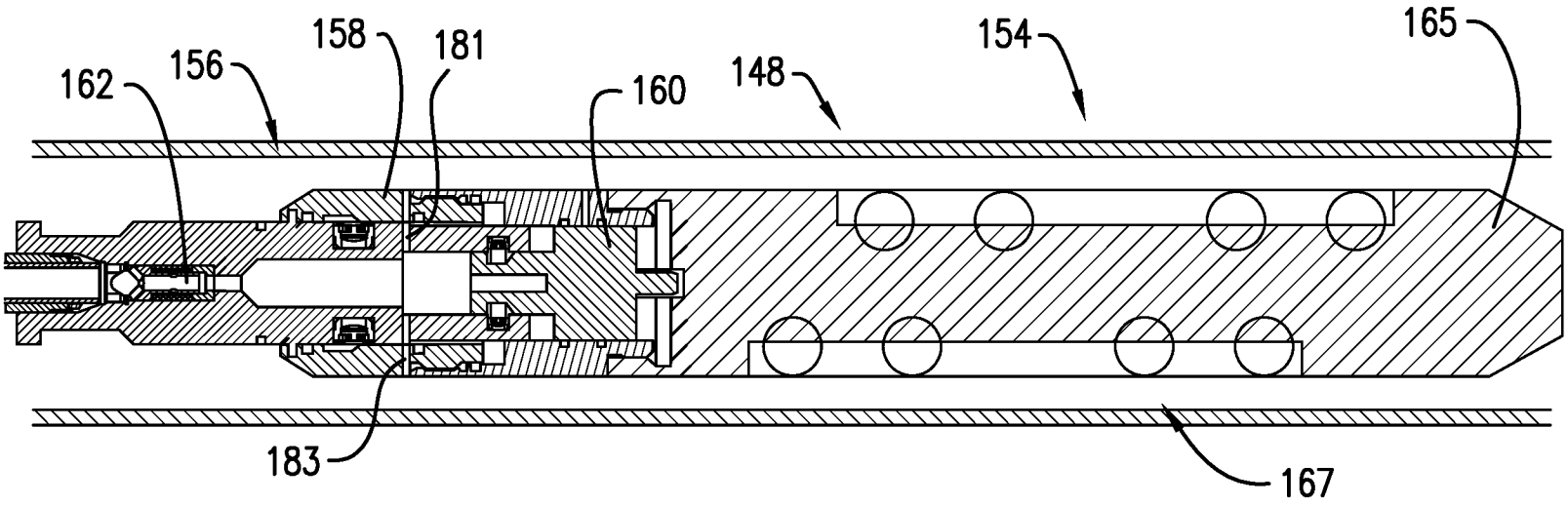
FIG. 25 depicts a cross-sectional side view of the chemical injector assembly of FIG. 17 in a retrieval configuration, in accordance with an exemplary aspect.

Once at the selected depth, chemical injection tubing 62 is held or pulled in an uphole direction (FIG. 21) to break a shear pin 177 causing fluid outlet ports 181 in injector valve 162 to align with fluid outlets 183 in housing 158 as shown in FIG. 22. Fluid, such as a selected chemical, is then introduced into tubular string 30 as shown in FIG. 23. When injection is complete, an uphole force may be applied causing a plurality of dogs 186 in injector valve 162 to align with corresponding recesses 188 in housing 158 as shown in FIG. 24. At the same time, motor 160 may disengage from tractor portion 154 allowing selectively deployable wheels 167 to retract such that chemical injector assembly 151 may be withdrawn from tubular string 30 as shown in FIG. 25.

At this point, it should be understood that the exemplary embodiments describe a system for introducing chemicals into completed wells that do not include a chemical injection system. The chemical injector assembly may be guided by fluid pressure or by a tractor to a selected depth, chemicals introduced, and the system withdrawn with little impact on production timelines. Further, by providing chemical injection in completed wells without chemical injection systems, the present invention enhances production by doing away with the need to withdraw tubing to correct any issues that may be caused by corrosion.

Set forth below are some embodiments of the foregoing disclosure:

Embodiment 1. A resource exploration and recovery system comprising: a first system; a second system extending into a wellbore, the second system including a completion having a casing defining a wellbore internal diameter; a chemical injection tubing extending from the first system into the completion, the chemical injection tubing including a terminal end portion; a chemical introduction system arranged at the first system and fluidically connected to the chemical injection tubing, the chemical introduction system being operable to deliver a chemical into the chemical injection tubing; and a chemical injection assembly mounted to the terminal end portion, the chemical injection system including an anchor system operable to secure the chemical injection assembly to the casing.

Embodiment 2. The resource exploration and recovery system according to any prior embodiment, wherein the chemical injection tubing includes an inner tubular defining a chemical resistant inner surface and an outer tubular defining one of an outer protective surface, a glide surface, and a stiffening element.

Embodiment 3. The resource exploration and recovery system according to any prior embodiment, wherein the inner tubular comprises one of stainless steel, carbon steel, and thermoplastic.

Embodiment 4. The resource exploration and recovery system according to any prior embodiment, wherein the outer tubular comprises a non-electrically conductive material including one of carbon fiber. Polyetheretherketone (PEEK), and polytetrafluoroethylene (PTFE).

Embodiment 5. The resource exploration and recovery system according to any prior embodiment, wherein the anchor system includes at least one selectively deployable slip mounted to the chemical injection assembly.

Embodiment 6. The resource exploration and recovery system according to any prior embodiment, wherein the anchor system includes an actuator rod operatively connected to the at least one selectively deployable slip.

Embodiment 7. The resource exploration and recovery system according to any prior embodiment, further comprising: a piston arranged in the chemical injection assembly, the piston being operatively connected to the actuator rod.

Embodiment 8. The resource exploration and recovery system according to any prior embodiment, further comprising: a retrieval system mounted in the chemical injection assembly through a shear pin. the retrieval system being operable to disengage the at least one selectively deployable slip.

Embodiment 9. The resource exploration and recovery system according to any prior embodiment, further comprising: collet fingers operatively connected to the retrieval system and the actuator rod, the collet fingers being selectively inwardly shiftable to release the actuator rod and disengage the at least one selectively deployable slip.

Embodiment 10. The resource exploration and recovery system according to any prior embodiment, wherein at least a portion of the chemical injection tubing is neutrally buoyant.

Embodiment 11. The resource exploration and recovery system according to any prior embodiment, wherein the chemical injection tubing includes a coating configured to trap air bubbles in the wellbore.

Embodiment 12. The resource exploration and recovery system according to any prior embodiment, wherein at least a portion of the chemical injection tubing includes a material impregnated with a buoyant material.

Embodiment 13. The resource exploration and recovery system according to any prior embodiment, wherein the buoyant material comprises gas.

Embodiment 14. The resource exploration and recovery system according to any prior embodiment, wherein the portion of the chemical injection tubing is neutrally buoyant in a selected fluid.

Embodiment 15. A method of securing a chemical injection assembly in a tubular, the method comprising: running the chemical injection assembly into a tubular string to a selected depth; delivering an activating force to an anchor system in the chemical injection assembly; and deploying the anchor system in response to the activating force to secure the chemical injection assembly in the tubular string.

Embodiment 16. The method according to any prior embodiment, wherein delivering the activating force include passing a pressurized fluid through injection tubing connected to the chemical injection system.

Embodiment 17. The method according to any prior embodiment, wherein deploying the anchor system includes deploying at least one selectively deployable slip.

Embodiment 18. The method according to any prior embodiment, wherein deploying the at least one selectively deployable slip include applying a force to a piston to contract a linkage and radially outwardly expand the at least one selectively deployable slip.

Embodiment 19. The method according to any prior embodiment, further comprising: releasing the anchor system from the tubular string.

Embodiment 20. The method according to any prior embodiment, wherein releasing the anchor includes: applying an uphole force to a retrieval member; shifting the retrieval member upwardly; deflecting collet fingers radially inwardly to release the piston; and allowing the linkage to expand and release the at least one selectively deployable slip.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A resource exploration and recovery system comprising:

a first system;

a second system extending into a wellbore, the second system including a casing tubular defining a wellbore internal diameter;

a completion extending through the casing tubular into the wellbore;

a chemical injection tubing extending from the first system into the completion, the chemical injection tubing including a terminal end portion;

a chemical introduction system arranged at the first system and fluidically connected to the chemical injection tubing, the chemical introduction system being operable to deliver a chemical into the chemical injection tubing; and a chemical injection assembly mounted to the terminal end portion of the chemical injection tubing, the chemical injection assembly including a first end including an injector portion fluidically connected with the chemical injection tubing and a second end supporting a mechanically operated anchor system fluidically connected to the chemical injection tubing through the injector portion, the mechanically operated anchor system being deployable from the chemical injection assembly to secure the chemical injection assembly to the completion.

2. The resource exploration and recovery system according to claim 1, wherein the chemical injection tubing includes an inner tubular defining a chemical resistant inner surface and an outer tubular defining one of an outer protective surface, a glide surface, and a stiffening element.

3. The resource exploration and recovery system according to claim 2, wherein the inner tubular comprises one of stainless steel, carbon steel, and thermoplastic.

4. The resource exploration and recovery system according to claim 2, wherein the outer tubular comprises a non-electrically conductive material including one of carbon fiber, Polyetheretherketone (PEEK), and polytetrafluorethylene (PTFE).

5. The resource exploration and recovery system according to claim 1, wherein the mechanically operated anchor system includes at least one selectively deployable slip mounted to the chemical injection assembly.

6. The resource exploration and recovery system according to claim 5, wherein the mechanically operated anchor system includes an actuator rod operatively connected to the at least one selectively deployable slip.

7. The resource exploration and recovery system according to claim 6, further comprising: a piston arranged in the chemical injection assembly, the piston being operatively connected to the actuator rod.

8. The resource exploration and recovery system according to claim 5, further comprising: a retrieval system mounted in the chemical injection assembly through a shear pin, the retrieval system being operable to disengage the at least one selectively deployable slip.

9. The resource exploration and recovery system according to claim 8, further comprising: collet fingers operatively connected to the retrieval system and the actuator rod, the collet fingers being selectively inwardly shiftable to release the actuator rod and disengage the at least one selectively deployable slip.

10. The resource exploration and recovery system according to claim 1, wherein at least a portion of the chemical injection tubing is neutrally buoyant.

11. The resource exploration and recovery system according to claim 10, wherein the chemical injection tubing includes a buoyant material including trapped bubbles.

12. The resource exploration and recovery system according to claim 10, wherein at least a portion of the chemical injection tubing includes a material impregnated with a buoyant material.

13. The resource exploration and recovery system according to claim 12, wherein the buoyant material comprises gas.

14. The resource exploration and recovery system according to claim 10, wherein the portion of the chemical injection tubing is neutrally buoyant in a selected fluid.

15. A method of securing a chemical injection assembly to a completion anchored to a casing tubular, the method comprising:

running chemical injection tubing supporting and fluidically connected to the chemical injection assembly into the completion to a selected depth;

passing injection fluid into the chemical injection assembly arranged at a terminal end of the chemical injection tubing;

delivering an activating force in the form of pressurized injection fluid through the chemical injection tubing to a mechanically operated anchor system in the chemical injection assembly; and deploying the mechanically operated anchor system from the chemical injection assembly in response to the activating force to secure the chemical injection assembly to the completion.

16. The method of claim 15, wherein deploying the mechanically operated anchor system includes deploying at least one selectively deployable slip.

17. The method of claim 16, wherein deploying the at least one selectively deployable slip include applying the activating force to a piston to contract a linkage and radially outwardly expand the at least one selectively deployable slip.

18. The method of claim 17, further comprising: releasing the anchor system from the tubular string.

19. The method of claim 18, wherein releasing the anchor includes:

applying an uphole force to a retrieval member;

shifting the retrieval member upwardly;

deflecting collet fingers radially inwardly to release the piston; and allowing the linkage to expand and release the at least one selectively deployable slip.

* * * * *